US005677961A

United States Patent [19]

von Reusner

[11] Patent Number: 5,677,961

[45] Date of Patent: Oct. 14, 1997

[54] CONNECTING ELEMENT FOR SPEAKER ELEMENTS

[76] Inventor: Johannes von Reusner, Schlobergstrasse 5, D-93161 Alling/Sinzing, Germany

[21] Appl. No.: 662,444

[22] Filed: Jun. 10, 1996

[30] Foreign Application Priority Data

Jun. 8, 1995 [DE] Germany ..... 195 20 954.0
Jun. 9, 1995 [DE] Germany ..... 195 21 124.3

[51] Int. Cl.[6] ..... H04R 1/02

[52] U.S. Cl. ..... 381/90; 381/88

[58] Field of Search ..... 381/90, 87, 88, 381/205, 188; 455/350, 349, 348, 346

[56] References Cited

U.S. PATENT DOCUMENTS 4,445,228 4/1984 Bruni ..... 455/350
4,811,403 3/1989 Henricksen et al. ..... 381/88
5,466,899 11/1995 Geisenberger ..... 381/71

*Primary Examiner*—Curtis Kuntz
*Assistant Examiner*—Vivian Chang
*Attorney, Agent, or Firm*—Hoffman, Wasson & Gitler

[57] ABSTRACT

A connecting element for speaker cabinets is provided having a housing which is open on at least one side with at least two connecting clips, which are provided on a housing wall for attaching speaker connecting cables. The interior space of the housing forms a shaft or section for inserting a module where first contacts can be connected to the section of shaft with electric elements of the speaker cabinet and two speakers are provided. A module has second contacts which produce an electrical connection between the module and the first contacts when the module is pushed into the shaft.

9 Claims, 5 Drawing Sheets

CONNECTING ELEMENT FOR SPEAKER ELEMENTS

The invention relates to a connecting element for speaker cabinets having a housing which is open on at least one side with at least two connecting clips which are provided on a housing wall for attaching speaker connecting cables, wherein the interior space of the housing forms a shaft or section for inserting a module where first contacts can be connected to the section or shaft with electric elements of the speaker cabinet and two speakers are provided, and where the module has second contacts which produce an electrical connection between the module and the first contacts when the module is pushed into the shaft. The connecting element may have a housing that is open on at least one side and has connecting clips which are provided on a housing wall for connecting speaker connecting cables, wherein the housing is simultaneously a bass-reflex tube with the interior space of the housing forming a shaft or section that is open on the side opposite the open at least one side.

Such a connecting element is known (JP 2-32 700 (A), Abstract). The housing of this connecting element that is provided at the back of the speaker cabinet is designed as an open tray. The connecting clips are provided at the base of the housing.

The object of the invention is to significantly improve such a connecting element, specifically even to the extent that is suitable for accommodating a module so that this module is freely accessible and, if required, can be replaced or exchanged at any time.

To achieve this object, a connecting element is designed having a housing which is open on at least one side with at least two connecting clips which are provided on a housing wall for attaching speaker connecting cables, wherein the interior space of the housing forms a shaft or section for inserting a module where first contacts can be connected to the section or shaft with electric elements of the speaker cabinet and two speakers are provided, and where the module has second contacts which produce an electrical connection between the module and the first contacts when the module is pushed into the shaft. The connecting element may have a housing that is open on at least one side and has connecting clips which are provided on a housing wall for connecting speaker connecting cables, wherein the housing is simultaneously a bass-reflex tube with the interior space of the housing forming a shaft or section that is open on the side opposite the open at least one side.

In the connecting element according to the invention, the connecting clips are present to connect speaker cables to an inside surface of the housing and are thus freely accessible even with a connecting element that is already installed.

In one design, the connecting element is made to accommodate a module. The connecting element according to the invention, however, can also be used as a bass-reflex tube, specifically especially in the case where there is no housing base or it is open.

In this case, the module is, for example, a frequency divider network module that contains at least a portion of the components of the frequency divider network of a speaker cabinet, specifically preferably all components of the network that are not fed directly with the current of the low-current speaker, i.e., for example, all components of the network that forms the frequency divider network with the exception of the choke that is in series with the low-current speaker. In the invention, this frequency divider network module can then be replaced without opening the speaker cabinet and without soldering from the outside for repair purposes, for purposes of adaptation or for updating, etc.

Instead of a frequency divider network module, a connecting module can also be used, by which then (in addition to the bass speaker which can, in any case, be directly controlled via the connecting clips) the other speaker of the cabinet can also be controlled directly, specifically for an active speaker cabinet.

In a preferred embodiment, the housing is made tubular at least in the area of the module shaft, so that this housing can also be used as a bass-reflex tube when the module is not used.

Further developments of the invention are the object of the subclaims.

The invention is explained in more detail below in an embodiment based on the figures. Here:

Figure 1:
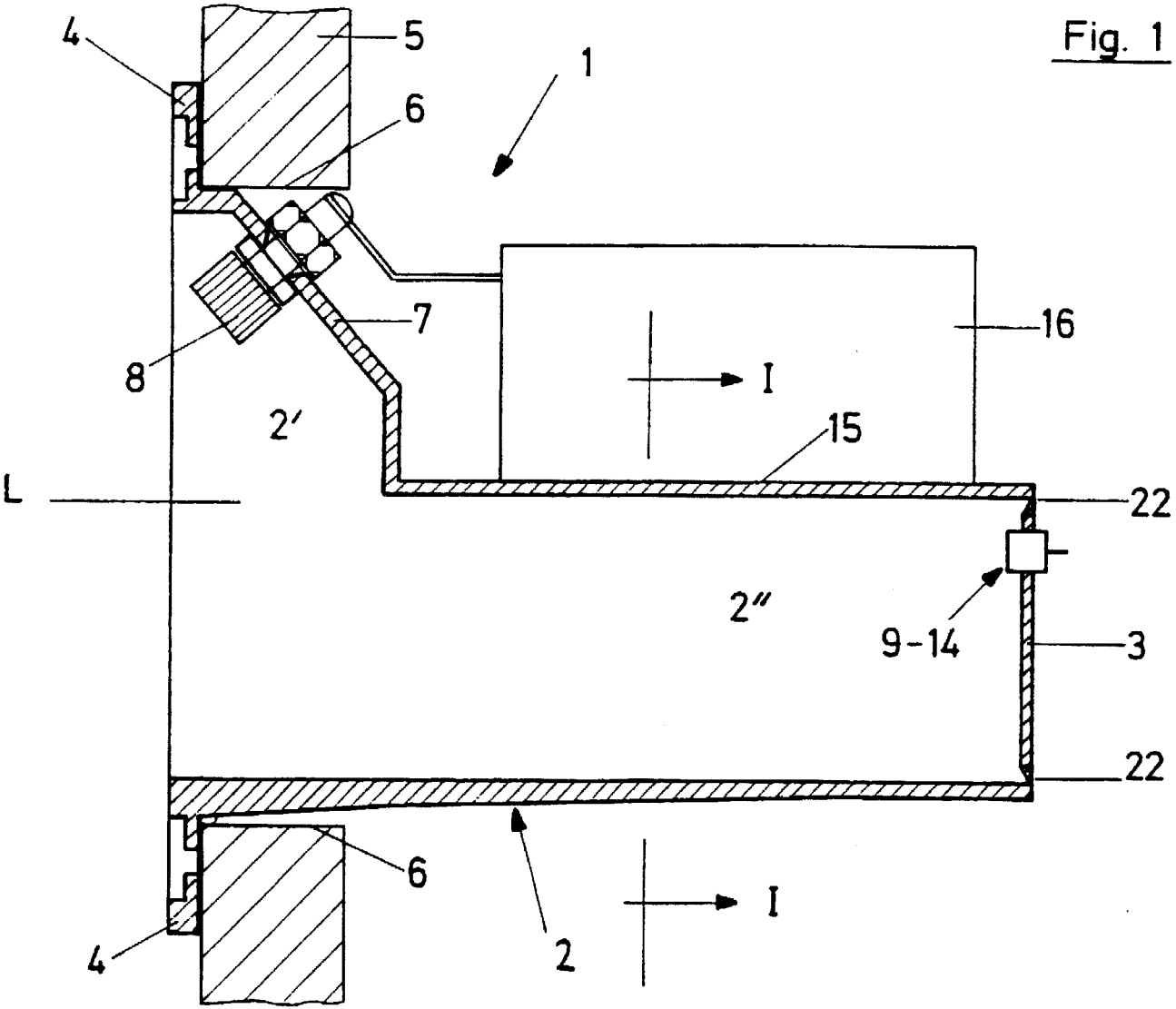
FIG. 1 shows, in simplified form and in a longitudinal section, a speaker connecting element corresponding to the invention.
Figure 4:
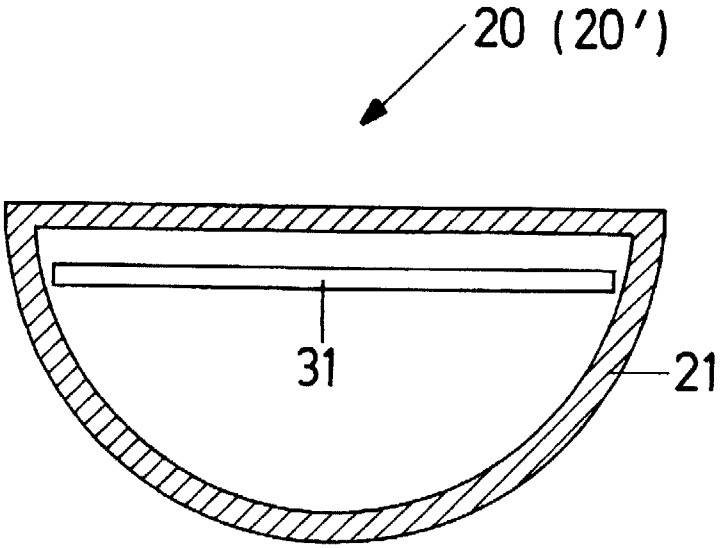
FIG. 4 shows a section through the module of FIG. 3.
Figure 2:
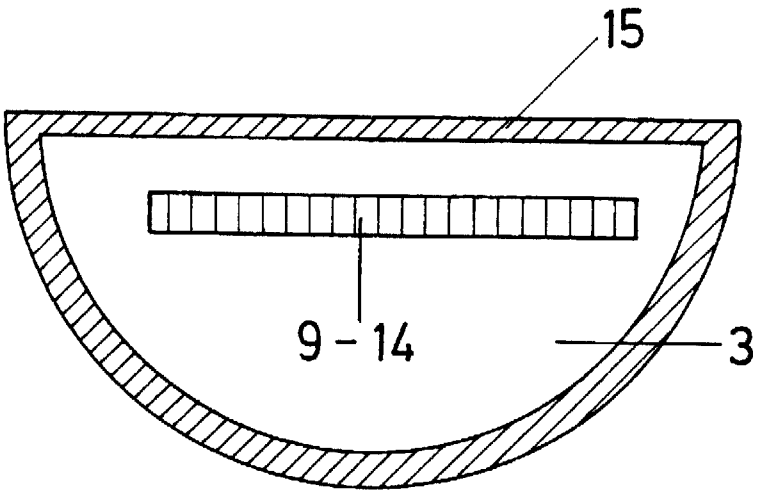
FIG. 2 shows a section corresponding to line 1—1 of FIG. 1.
Figure 3:
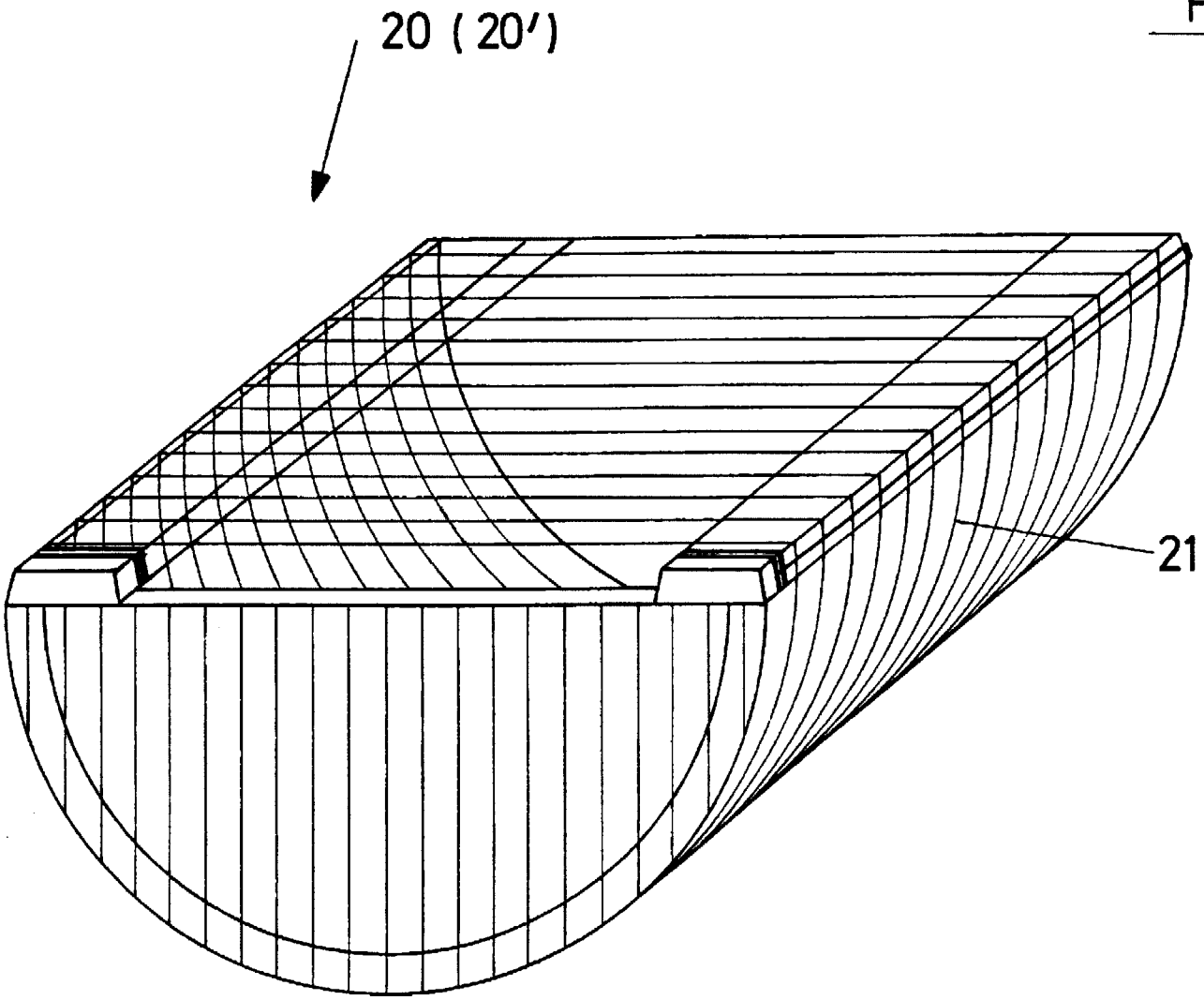
FIG. 3 shows a frequency divider network module for use in the connecting clips of FIG. 1.

Connecting element 1 for speaker cabinets that is depicted in the figures consists basically of a basin-like housing 2 that is made of plastic by injection-molding, which is open on the left side in FIG. 1 and is closed on the right side in this figure by a base 3. On the open side, housing 2 has a mounting flange 4, by means of which connecting element 1 can be attached to back 5 of a speaker cabinet that otherwise is not depicted in greater detail, specifically in the area of an opening 6 that is matched to the housing cross-section, in such a way that housing 2 extends into the interior of the speaker cabinet. On the open side, the connecting element in the embodiment depicted has a circular or basically circular cross-section, specifically concentric to a longitudinal axis that is marked "L" in FIG. 1. In the area of a front, shorter housing section 2,' this circular cross-section increasingly turns into a semi-circular cross-section, which housing 2 then consistently exhibits in the area of a section 2" over the majority of its length and which extends up to base 3. In section 2', housing 2 has a planar housing wall 7 that extends obliquely and that in the sectional view of FIG. 1 forms with longitudinal axis L of housing 2 an angle of less than 90°, for example an angle of 45°, which opens toward the open side of the housing. On planar housing wall 7, two screwable connecting clips 8 that are offset one behind the other in the direction perpendicular to the plane of projection of FIG. 1 are provided, to which speaker cables that are equipped with pole shoes can be connected.

Two connecting clips 8 are connected in the way depicted in FIG. 5 and described in more detail below to various components of the speaker cabinet or to some of contacts 9–14 that are provided at base 3, which are formed, for example, from a multiple-box strip that is provided at base 3 or at an opening there.

On the outside of housing 2 that is formed by a planar housing wall 15 of section 2", a choke 16 for bass speaker 17 of the speaker cabinet is attached which, in addition to this base speaker 17, also has a mid-range speaker 18 and a treble speaker 19.

A module which consists of a closed housing 21 that is made of plastic, whose outside cross-section is matched to the cross-section of section 2" in such a way that this module can be inserted into section 2" of housing 2, is referred to as 20. With the exception of choke 16, module 20 contains all other components that are necessary for the passive frequency divider of the speaker cabinet and at its back has various contacts 9a–14a, which are formed by a multiple connector strip in such a way that after module 20 is inserted into housing 2 or into shaft or section 2", contacts 9a–14a in each case are electrically connected to a corresponding contact of contacts 9–14, specifically contact 9a to contact 9, contact 10a to contact 10, etc.

By a predetermined point of break 22, which extends along the entire periphery of base 3, the latter can be punched out, specifically if module 20 is not used, and the components of the frequency divider network that are required in addition for choke 16 are provided in a different way or on another board within the speaker cabinet. Connecting element 1 or its housing 2 is then used as a bass-reflex tube of the speaker cabinet with base 3 that is punched out.

Figure 5:
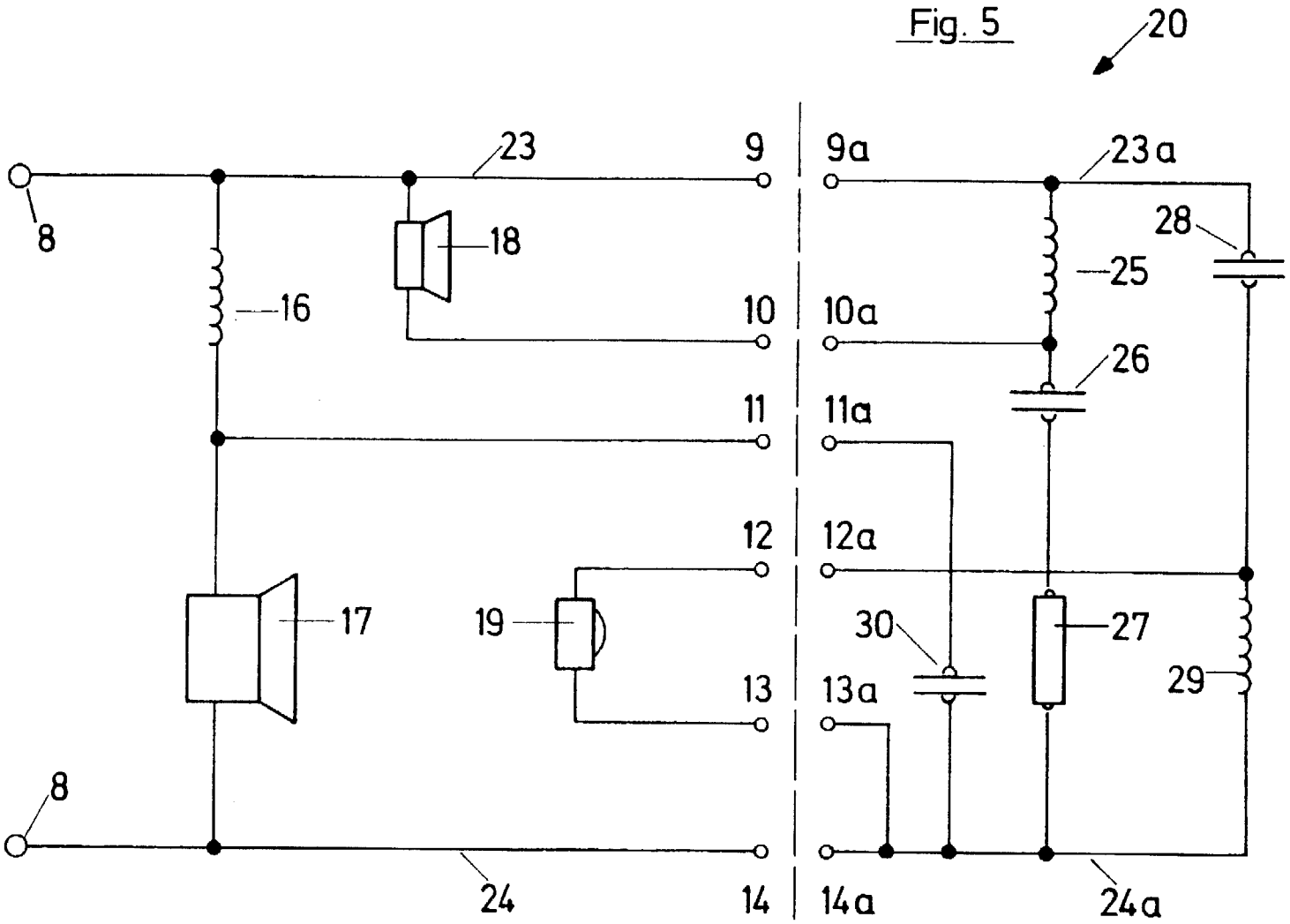
FIGS. 5 and 6 shows electric circuits of a speaker cabinet, in each case with the use of a connecting element according to the invention, with a module.

FIG. 5 shows as an example one option for the electric circuit. As shown, one threaded terminal 8 is connected via a conductor 23 to contact 9, and other threaded terminal 8 is connected via a conductor 24 to contact 14. Between two conductors 23 and 24, bass speaker 17 is in series with choke 16. In addition, mid-range speaker 18 is connected to conductor 23 by a connection. The other connection of the mid-range speaker is connected to contact 10. The connecting point between choke 16 and one connection of bass speaker 17 is connected to contact 11. The two connections of treble speaker 19 are connected to contacts 12 and 13.

The network of the frequency divider that is provided in module 20 has two conductors 23a and 24a, which are connected to contacts 9a or 14a and between which is, on the one hand, a series connection consisting of inductor 25, condenser 26 and resistor 27 and, on the other hand, a series connection consisting of condenser 28 and inductor 29. Directly parallel to two connections 9a and 10a is inductor 25, so that when module 20 is used, this inductor 25 is parallel to mid-range speaker 18 and the latter is connected to conductor 24 via the series connection consisting of condenser 26 and resistor 27 via connected contacts 14 and 14a. Contact 11a is connected via another condenser 30 to conductor 24a, i.e., when module 20 is inserted in the module shaft located there, this condenser 30 is parallel to bass speaker 17. Contact 13a, just as contact 14a, is connected directly to conductor 24a. Parallel to contact 12a and contact 13a is inductor 29. Condenser 28 is parallel to contacts 9a and 12a, so that when module 20 is inserted into housing 2 or into the module shaft located there, inductor 29 is provided parallel to treble speaker 19, and treble speaker 19 is connected with its one connection directly to conductor 24 and with its other connection via condenser 28 to conductor 23.

The special feature also consists in the fact that only relatively low output or current must be transmitted via contacts 9–14 or 9a–14a, so that reliable operation of the speaker cabinet is ensured despite the plug-in contacts used between connecting element 1 and module 20.

Components 25–30 of module 20 are provided on a board 31 (printed circuit board) that is installed in housing 21. This printed circuit board also has the plug-in strips that form contacts 9a–14a.

The advantages of connecting element 1 are, i.a.:

With the exception of choke 16, the elements of the passive frequency divider network of a speaker cabinet are always installed in an accessible manner in connecting element 1 outside the interior space of the speaker cabinet.

It is thus possible to replace this portion of the frequency divider network without opening the speaker cabinet and even without soldering, specifically, for example, for repairs or for an update of the speaker cabinet.

With different modules 20, it is further possible to adapt the same speaker cabinet in various ways just by replacing module 20, specifically, for example, for pop, jazz, classical and/or different size rooms and/or different sound characteristics. Replaceable module 20 is also especially suitable for testing and development purposes.

As already stated above, housing 2 can be used as a bass-reflex tube when a module is not in use by breaking off base 3.

Figure 6:
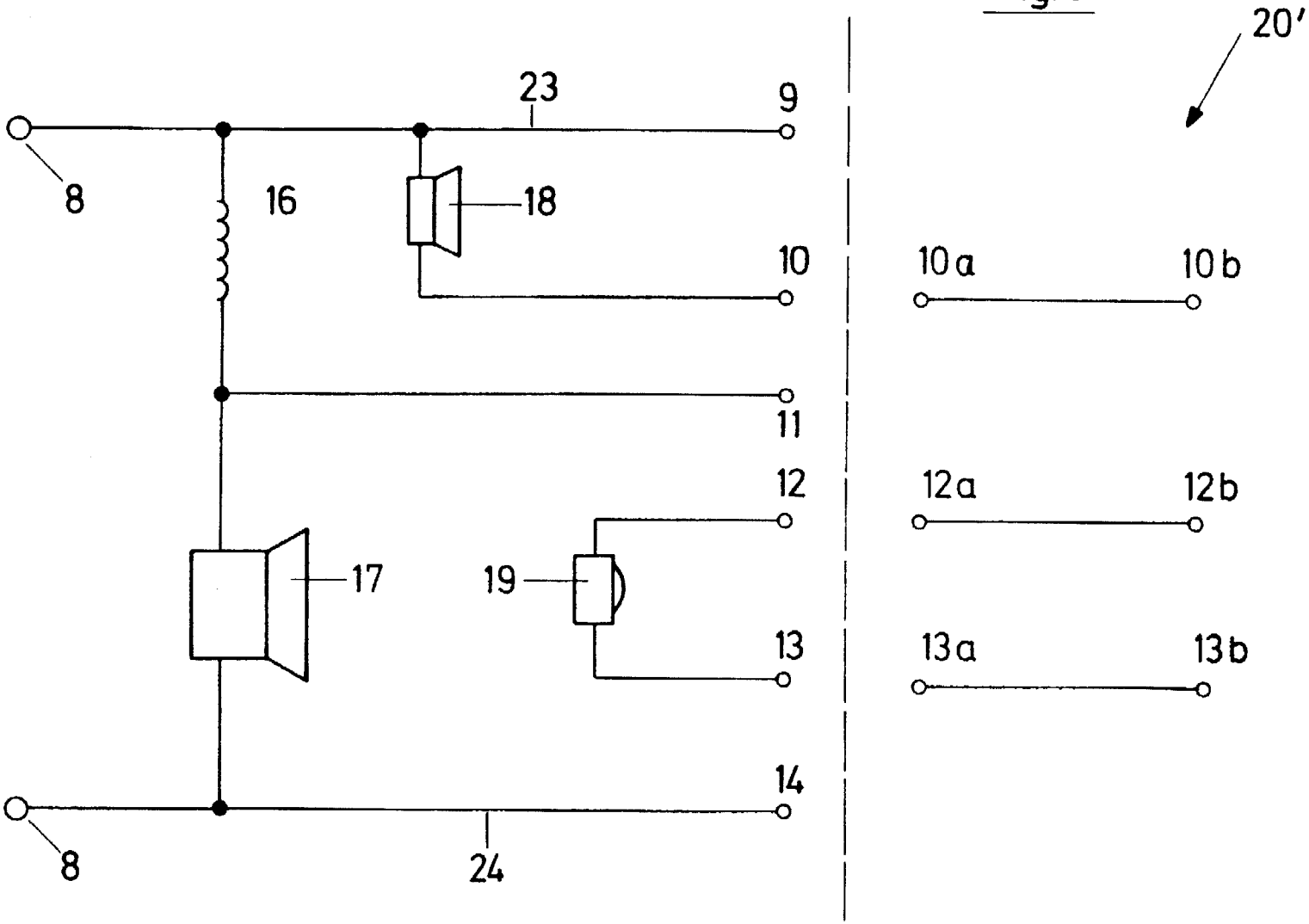

In addition, it is also possible in the invention to use, instead of module 20, a module 20', which does not have passive structural elements 25–30 according to FIG. 6, but in which at least connections 10a, 12a and 13a in each case are connected directly to a corresponding connecting clip 10b, 12b or 13b, by which then in connection with connecting clips 8, individual speakers 17–19 can be directly controlled via separate amplifiers or amplification stages. In this case, connecting clips 10b, 12b and 13b are located on the other fronts of module 20a that face away from contacts 10a, 12a and 13a.

It goes without saying that the axial length of housing 2 is selected in such a way as to ensure that module 20 or 20' fits into this housing. If module 20 in housing 2 can be pushed in to the extent that it is accommodated completely by section 2", this module preferably has a handling surface that makes it easy to pull module 20 out, on its front side facing away from contact 9a–14a. Contacts or clips 10b, 12b, 13b that are located there are used in module 20' as handling surfaces.

In each case, conductors 23 and 24 are designed at least partially extended on the outside surface of housing 2, for example as strip conductors.

Base 3 can also be omitted. Contacts 9–14 are then provided on, for example, housing wall 15, and contacts 9a–14a are provided at the top side of module 20 or 20'.

List of Reference Symbols

| | |
|---|---|
| 1 | Connecting element |
| 2 | Housing |
| 2', 2" | Housing section |
| 3 | Base |
| 4 | Mounting flange |
| 5 | Back wall |
| 6 | Opening |
| 7 | Housing wall |
| 8 | Threaded terminal |
| 9–14 | Contact |
| 9a–14a | Contact |
| 10b, 12b, 13b | Threaded terminal |
| 15 | Housing wall |
| 16 | Choke |
| 17, 18, 19 | Speaker |
| 20, 20' | Module |
| 21 | Housing |
| 22 | Predetermined point of break |
| 23, 24 | Conductor |
| 23a, 24a | Conductor |
| 25 | Inductor |
| 26 | Condenser |
| 27 | Resistor |
| 28 | Condenser |
| 29 | Inductor |
| 30 | Condenser |
| 31 | Board |

I claim:

1. A connecting element for speaker cabinets comprising:

a housing open on at least one side, at least two connecting clips provided on a housing wall for attaching speaker connecting cables, said housing having an interior space which forms a shaft exchangeably receiving a module forming a replaceable frequency divider network module which contains components of one of a frequency divider and said frequency divider network of said speaker cabinet first electrical contacts on said shaft which are connectable to electrical elements of said speaker cabinet and two speakers, and second electrical contacts on said module which produce an electrical connection between said module and said first contacts when said module is pushed into said shaft.

2. A connecting element according to claim 1, wherein said module is a connecting module that makes it possible to control speakers of said speaker cabinet separately.

3. A connecting element according to claim 1, wherein said module has a housing, whose outside cross-section is matched to a cross-section of said module-shaft.

4. A connecting element according to claim 1, wherein one of said first contacts is provided at a base of said housing and one of said second contacts is provided on a front of said module, which is adjacent to a base when said module is inserted into said shaft.

5. A connecting element according to claim 1, wherein said shaft and said housing of said module have a semicircular cross-section.

6. A connecting element according to claim 1, wherein said housing, at least in an area of said shaft, is formed by a tubular housing section.

7. A connecting element according to claim 1, wherein said housing has a closed periphery and base.

8. A connecting element according to claim 7, wherein said base is connected via a predetermined point of break to said housing.

9. A connecting element according to claim 1, wherein said housing has an open periphery as well as an open base.

* * * * *